US007540272B2

(12) United States Patent
Ishizaka et al.

(10) Patent No.: US 7,540,272 B2
(45) Date of Patent: Jun. 2, 2009

(54) FUEL SUPPLY DEVICE

(75) Inventors: Kazuhiro Ishizaka, Saitama (JP); Tomohiro Miyauchi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 69 days.

(21) Appl. No.: 11/806,330

(22) Filed: May 31, 2007

(65) Prior Publication Data

US 2008/0271710 A1 Nov. 6, 2008

(30) Foreign Application Priority Data

May 31, 2006 (JP) ..... P2006-151535

(51) Int. Cl.
*F02M 69/46* (2006.01)
*F02M 69/50* (2006.01)

(52) U.S. Cl. ..... 123/469; 123/456

(58) Field of Classification Search ..... 123/456, 123/447, 467, 468, 469, 470, 195 P
See application file for complete search history.

(56) References Cited

U.S. PATENT DOCUMENTS 5,762,040 A * 6/1998 Taipale et al. ..... 123/299
5,791,304 A * 8/1998 Taipale ..... 123/73 C
6,672,287 B2 * 1/2004 Wada et al. ..... 123/468
6,752,127 B2 * 6/2004 Mori ..... 123/456
7,004,146 B1 * 2/2006 Kato ..... 123/467
7,040,289 B2 * 5/2006 Nigrin et al. ..... 123/447
7,213,577 B2 * 5/2007 Hummel et al. ..... 123/469
2002/0185110 A1 * 12/2002 Wada et al. ..... 123/445
2003/0070658 A1 * 4/2003 Warner et al. ..... 123/456
2003/0084881 A1 * 5/2003 Mori ..... 123/456

FOREIGN PATENT DOCUMENTS

JP 10-176621 A 6/1998
JP 10-218089 A 8/1998

* cited by examiner

*Primary Examiner*—Mahmoud Gimie
(74) *Attorney, Agent, or Firm*—Westerman, Hattori, Daniels & Adrian, LLP.

(57) ABSTRACT

The invention provides a fuel supply device, which is possible to prevent undesired water entered into a fuel path from remaining therein with a simple arrangement. A fuel supply pipe for supplying fuel to each of the fuel injection valves of an engine disposed with a plurality of cylinders in a vertical direction includes a fuel path in longitudinal direction, a smaller diameter portion formed perpendicular to the fuel path and continuous with a fuel injection valve mounting hole, and a cap attached to a lower end of the fuel path. The cap is arranged so that the upper end of its protruding portion is positioned at the same or nearly same level as that in height of the smaller diameter portion. Thus, the water entered in the fuel supply pipe is exhausted through the smaller diameter portion without delay.

8 Claims, 4 Drawing Sheets

FUEL SUPPLY DEVICE

BACKGROUND OF THE INVENTION

1. Field of the Invention

The present invention relates to a fuel supply device, particularly to a fuel supply device that prevents undesired water entered into a fuel path from remaining therein with a simple structure.

2. Description of the Related Art

Conventionally, there are known outboard motors mounted with a multi cylinder engine, each cylinder of which is attached with a fuel injection device. In such outboard motors, the following arrangement is well known. That is, fuel, which is pressurized by a fuel pump and fed out through a fuel hose, is equally distributed and supplied to each of the fuel injection valves through a rail-like fuel supply pipe called a delivery pipe.

A patent document 1 discloses the following arrangement. That is, a fuel supply device for outboard motors is provided with a fuel transfer pipe for supplying fuel from a fuel pump and a return pipe for returning excess fuel to a sub tank being attached at one end and another end of the above-mentioned rail-like fuel supply pipe, respectively. According to this arrangement, water entered into the fuel supply pipe from a fuel transfer pipe is sucked into the fuel injection valve along with the fuel. Even when the water is not sucked into the fuel injection valve, since the water is returned into the sub tank along with the excess fuel, it is possible to prevent the water from remaining within the fuel supply pipe.

A patent document 2 discloses the following arrangement. That is, in the fuel supply device for outboard motors, a fuel pump and a pressure regulator are disposed within a case of a vapor separator for separating vapor included in the fuel thereby eliminating a pipe necessary for returning excess fuel from the fuel supply pipe. According to this arrangement, no return structure including a return pipe is needed and a fuel supply system is simplified.

[Patent document 1] Japanese Published Unexamined Patent Application No. H10-176621

[Patent document 2] Japanese Published Unexamined Patent Application No. H10-218089

However, in the fuel supply device disclosed in the patent document 1, although there is no possibility that water entered into the fuel supply path remains within the fuel supply pipe, there are such disadvantages that an installation space for the return structure including the return pipe is needed and the cost for component parts and the number of man-hours are also increased.

In the art of the patent document 2, since no outlet of the fuel is provided other than the fuel injection valve, it is preferred that such an arrangement is provided that, when water enters into the fuel path, the water is reliably sucked from the fuel injection valve. However, the fuel supply device disclosed in the patent document 2 is not provided with such the arrangement.

SUMMARY OF THE INVENTION

It is an object of the present invention to provide a fuel supply device, which is possible to prevent undesired water entered into a fuel path from remaining therein with a simple arrangement.

To achieve the above object, the present invention has a first characteristic in that a fuel supply device for supplying fuel to each of the fuel injection valves of a multi cylinder engine disposed with a plurality of cylinders in a vertical direction, the fuel supply device, includes: a fuel supply pipe, which is formed with a fuel path extending upward from its lower end, a cap inserted to fit with the fuel supply pipe, and a plurality of mounting holes, which is formed perpendicular to the fuel path, each of a plurality of the mounting holes being inserted with a fuel inlet side of the fuel injection valve to fit therewith, wherein the upper end of the cap is disposed substantially at the same level in height of the lowest mounting hole in the plurality of mounting holes. Preferably, the upper end of the cap is disposed substantially at the same height as the lower edge of the lowest mounting hole.

Therefore, even when undesired water is entered into the fuel path, the water is exhausted from the lowest mounting hole to a fuel injection portion without delay thereby preventing the water from remaining inside the fuel supply pipe. As a result, water is prevented from remaining inside the fuel supply device having no return structure or drain, and thus stable operation of the outboard motor can be ensured.

The present invention has a second characteristic in that the cap includes a collar to form a holding groove for the O-ring and a protruding portion of a smaller diameter extending toward the fuel path from an upper side of the collar, wherein the upper end of the protruding portion forms the upper end of the cap.

Therefore, the fuel supply device that prevents water entered inside the fuel path from remaining therein with a simple structure is obtained. Also, a step is formed between the collar and the protruding portion. Therefore, an insertion amount of the cap can be held at a constant level by forming a step corresponding to the step on the fuel supply pipe side.

The present invention has a third characteristic in that each of the plurality of mounting holes is constituted of a larger diameter portion that fits with the fuel inlet side of the fuel injection valve and a smaller diameter portion formed concentrically with the larger diameter portion, wherein the upper end of the cap is disposed substantially at the same height as the lower edge of the smaller diameter portion.

Therefore, since an edge of the smaller diameter portion is disposed close to the axial center of the fuel injection valve, the fuel injection valve can suck the water entered inside the fuel path more easily.

DETAILED DESCRIPTION OF THE PREFERRED EMBODIMENTS

Figure 1:
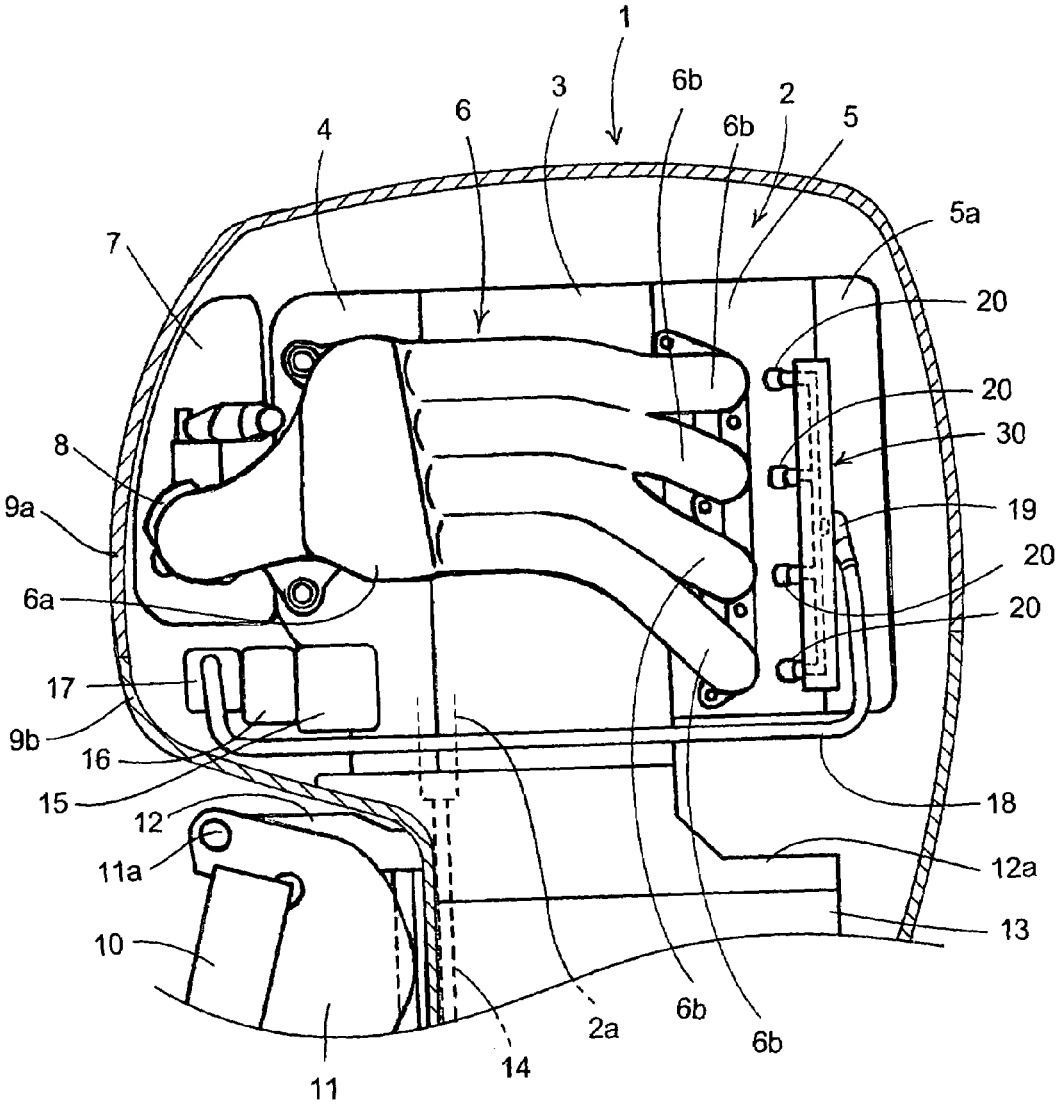
FIG. 1 is a side view of an outboard motor according to an embodiment of the present invention.

Referring to the drawings, preferred embodiments of the present invention will be described in detail below. FIG. 1 is a side view of an outboard motor according to an embodiment to which the present invention is applied. An outboard motor 1 is a well-known type outboard motor mounted on various kinds of boats. The outboard motor 1 is attached to a stern board 10 via a stern bracket 11 and drives a propeller (not shown) to rotate for generating propulsion of a boat. A swivel case 12 is supported on a rotary shaft 11*a* of the stern bracket 11 in a manner to be tilted freely. The swivel case 12 is coupled with a mount case 12*a*, and on the upper face of the mount case 12*a*, an engine 2 is mounted. Attached under the mount case 12*a* is an extension case 13, which permits a drive shaft 14 for transmitting a driving force to the propeller to pass through the extension case 13. The drive shaft 14 is coupled with an output shaft, which is coaxial with a crankshaft 2*a* of the engine 2, within the mount case 12*a*. Substantially entire engine 2 is covered with an upper cover 9*a* detachably attached to a lower cover 9*b*.

The engine 2 of an in-line 4-cylinder type is mounted with the crankshaft 2*a* oriented in a vertical direction. Therefore, the respective cylinders are disposed vertically. In the engine 2 according to the embodiment, the respective cylinders are disposed in a substantially vertical direction. The engine 2 is composed of a crankcase 4, a cylinder block 3, a cylinder head 5, a cylinder head cover 5*a* being disposed and connected to each other in the mentioned-order backward from the crankcase 4 at the stern side. An intake device 6 is attached to the side face of the engine 2 so as to bridge over the crankcase 4, the cylinder block 3 and the cylinder head 5. The intake device 6 introduces fresh air from a silencer chamber 7 disposed at the forward side of the crankcase 4. Between the intake device 6 and the silencer chamber 7, a throttle body 8 is disposed for controlling the intake amount of the fresh air. The fresh air guided to a surge tank 6*a* is introduced to an intake port of the respective cylinders formed on the cylinder head 5 through a multi-branched intake pipe 6*b*.

The fuel supply device of the engine 2 according to the embodiment is applied with a fuel injection system. In FIG. 1, below the crankcase 4, there are disposed a sub tank 15 that temporarily reserves fuel drawn from a fuel tank (not shown), high pressure fuel pump 16 that pressurizes the fuel from the sub tank 15 and feeds out therefrom, and a filter 17 that filters the pressurized and fed fuel. The end of a fuel hose 18 extending from the filter 17 is connected to a fuel supply pipe 30 attached to the cylinder head 5 via a connector 19.

The fuel supply pipe 30 is a component part that distributes and supplies the fuel, guided to a portion adjacent to the cylinder head cover 5*a* by the fuel hose 18, at an equal pressure to each of the fuel injection valves 20 provided to the respective cylinders. The fuel supply pipe 30 according to the embodiment is attached to the cylinder head 5 with its longitudinal direction oriented vertically in accordance with the disposition of the cylinders and the fuel injection valves 20. The fuel injection valves 20 are fixed between the cylinder head 5 and the fuel supply pipe 30 in a sandwiching manner by attaching the fuel supply pipe 30 to the cylinder head 5 using bolts or the like.

Figure 2A:
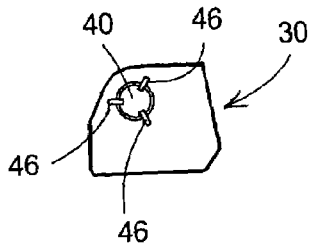
FIG. 2A and FIG. 2B are a top face view and a side view of a fuel supply pipe, respectively, according to an embodiment of the present invention.
Figure 2B:
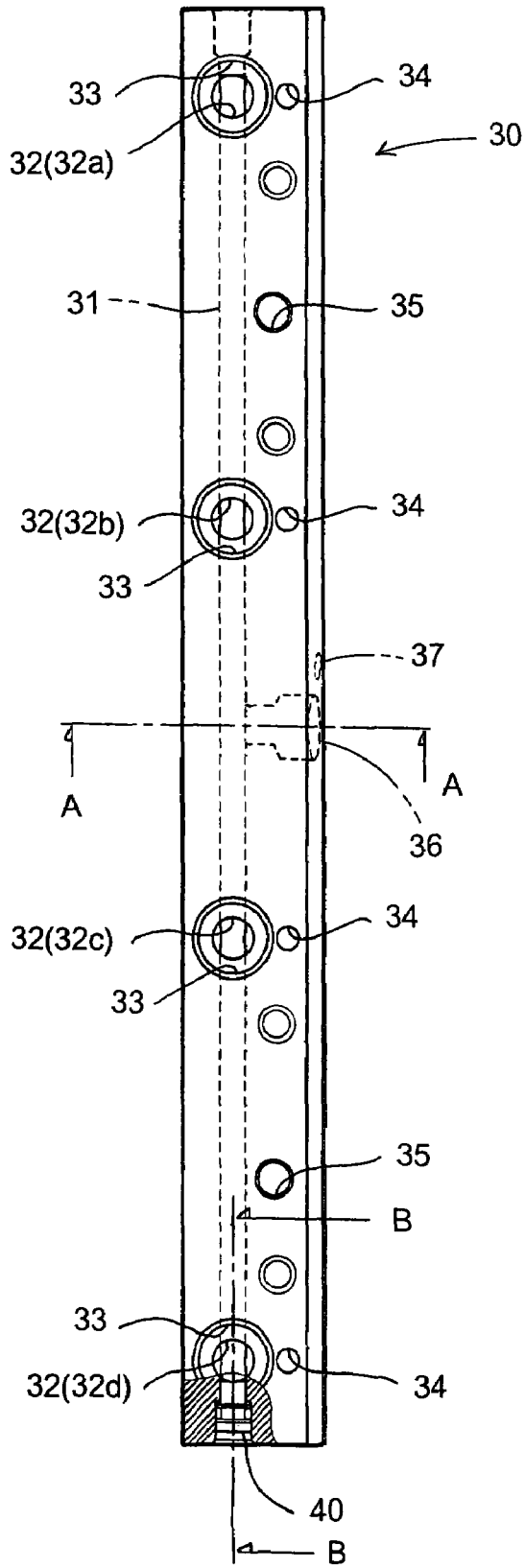

FIG. 2A is a top face view and FIG. 2B is a side view of the fuel supply pipe 30, respectively. The fuel supply pipe 30 according to the embodiment is a component having a polygonal pole-like shape, which is integrally formed of a metal such as an aluminum alloy. Formed on the outer surface of the fuel supply pipe 30 are a plurality of fuel injection valve mounting holes 33 in each of which the fuel injection valve 20 is inserted, a plurality of positioning concave portions 34 for positioning the fuel injection valve 20 in the peripheral direction when attaching the valve to the fuel supply pipe 30, a plurality of through holes 35 that permits bolts (not shown) for jointing the fuel supply pipe 30 to the cylinder head 5 to go through, a connector mounting hole 36 into which the connector 19 is inserted and a bolt hole 37 for attaching the connector 19 to the fuel supply pipe 30.

Inside the fuel supply pipe 30, a fuel path 31 passing therethrough in its longitudinal direction is formed. In the direction perpendicular to the fuel path 31, the plurality of fuel injection valve mounting holes 33 are formed being continuous with the fuel path 31. Each of the fuel injection valve mounting holes 33 is preferably circular and formed of a larger diameter portion that fits with the fuel inlet side of the fuel injection valve 20 and a smaller diameter portion 32 (32*a*, 32*b*, 32*c*, 32*d* from the top in FIG. 2B) formed concentrically with the larger diameter portion. The smaller diameter portion 32 may be other shapes, such as a polygon. To the upper and lower ends of the fuel path 31, a cap 40 is attached respectively for closing the upper and lower openings of the fuel path 31. Each of the caps 40 is inserted with pressure into the fuel path 31 and fixed at three caulking portions 46 on the upper/lower end portion of the fuel supply pipe 30 as shown in FIG. 2A.

Figure 3:
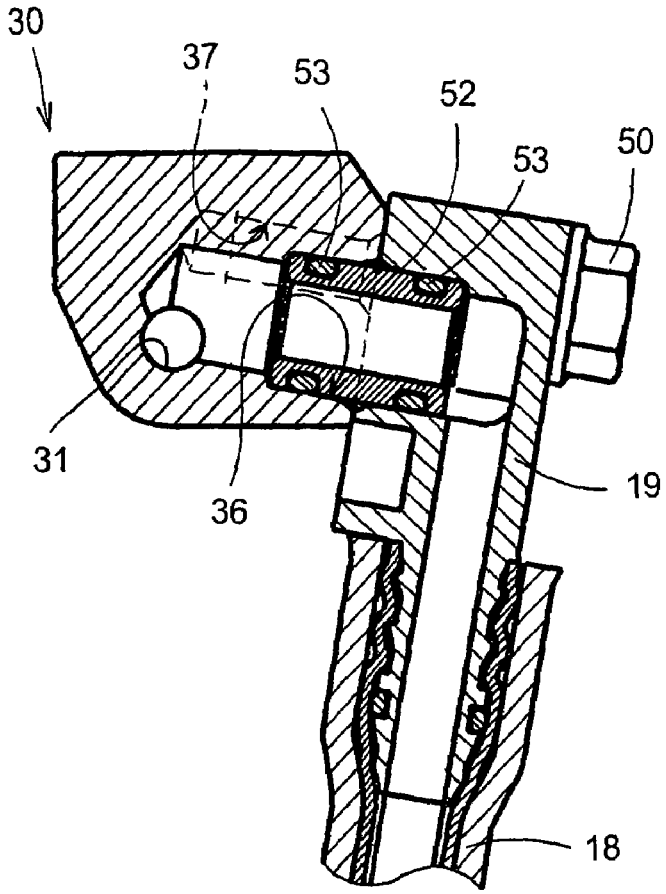
FIG. 3 is a cross-sectional view taken along the line A-A in FIG. 2B.

FIG. 3 is a cross-sectional view taken along the line A-A in FIG. 2B. Items having identical reference numerals are identical or equivalent items described above. The connector 19 coupled with the end of the fuel hose 18 is jointed with the fuel supply pipe 30 by means of a bolt 50. The fuel supply pipe 30 and the connector 19 are held in a sealed state by means of a coupling pipe 52 provided with two O-rings 53. The pressured fuel supplied through the fuel hose 18 is distributed and supplied to each of the smaller diameter portions 32 (32*a* to 32*d*) through the fuel path 31, which is continuous with the connector-mounting hole 36.

Figure 4A:
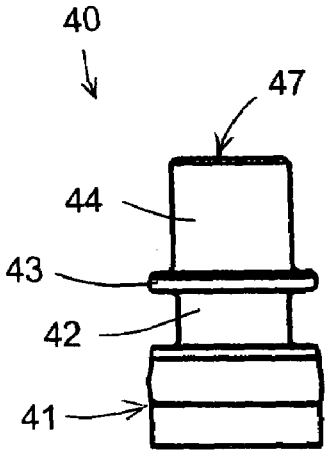
FIG. 4A is a side view of a cap and FIG. 4B is the side view of the cap with an O-ring, according to an embodiment of the present invention.
Figure 4B:
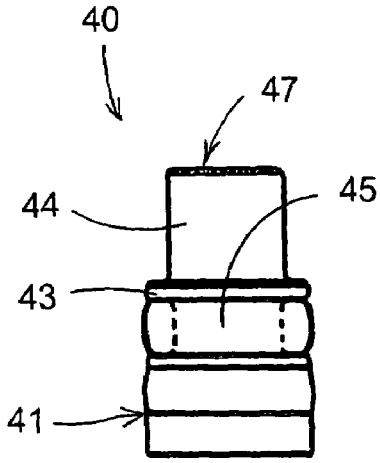

FIG. 4A is a side view of the cap 40, and FIG. 4B is a side view of the cap 40 attached with an O-ring 45. The cap 40, which is integrally formed of metal or the like, includes a body 41, a holding groove 42, which is fitted with the O-ring 45, a collar 43 and a protruding portion 44. The upper end 47 of the protruding portion 44 is the end that is inserted into the fuel path 31. The O-ring 45 formed of rubber or the like has a function to come into contact with the inner peripheral surface of the opening of the fuel path 31 to seal therebetween. The dimension of the outer diameter of the protruding portion 44 is formed smaller than that of the body 41.

Figure 5:
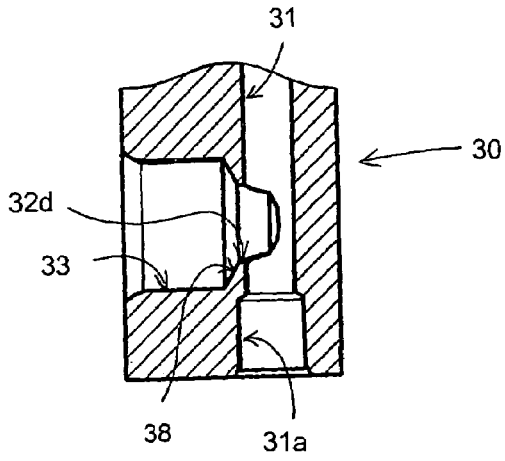
FIG. 5 is a cross-sectional view taken along the line B-B in FIG. 2B.

FIG. 5 is a cross-sectional view taken along the line B-B in FIG. 2B. FIG. 5 shows a state that the cap 40 is not inserted. As described above, inside the fuel injection valve mounting hole 33, the smaller diameter portion 32 (32*d*) is formed. In the opening of the fuel path 31, the cap insertion hole 31*a* having a diameter larger than that of the fuel path 31 is formed. The depth of the cap insertion hole 31*a* is set to a predetermined depth in which the thickness of the circumferential edge 38 of the smaller diameter portion 32*d* is not too thin.

Figure 6:
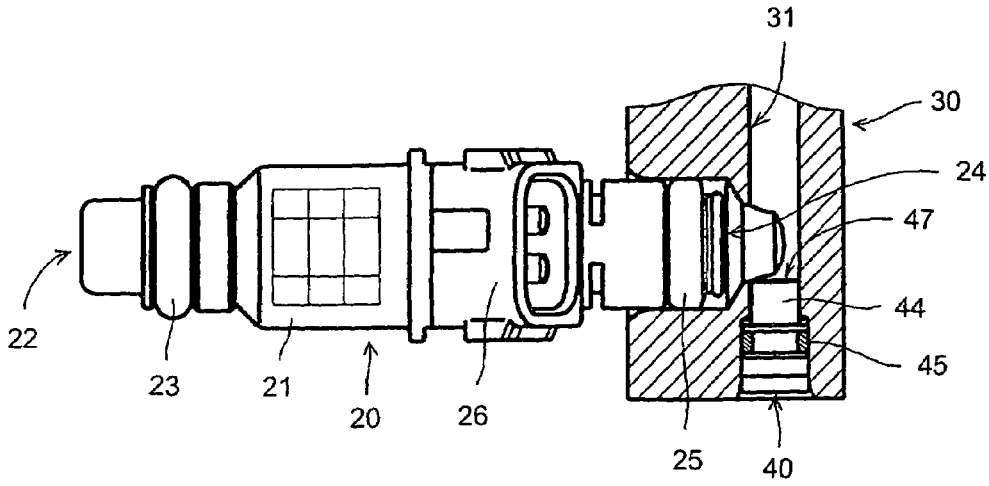
FIG. 6 is a cross-sectional view taken along the line B-B in FIG. 2B including a fuel injection valve and a cap.

FIG. 6 is a cross-sectional view showing a state that the fuel injection valve 20 and the cap 40 are attached to the fuel supply pipe 30. The fuel injection valve 20 is arranged so as to be stably fixed in the following manner. That is, an injection side nozzle 22 attached with an O-ring 23 is inserted into the cylinder head 5, an intake side nozzle 24 attached with an O-ring 25 is inserted into the fuel supply pipe 30 and the fuel supply pipe 30 is jointed with the cylinder head 5. The position of a connector 26 in the peripheral direction thereof, which inputs a drive signal to the fuel injection valve 20, is fixed to a predetermined position when an engagement projection (not shown) formed on the body 21 is engaged with the positioning concave portion 34 (refer to FIG. 2B).

The cap 40 is attached by inserting the same into the cap insertion hole 31*a* with pressure from the bottom side in FIG. 2B. Since the collar 43 formed on the cap 40 (refer to FIG. 4)

comes into contact with a step between the fuel path 31 and the cap insertion hole 31*a*, the cap 40 can be always attached at a predetermined insertion amount. The fuel supply pipe 30 according to the embodiment is arranged so that, when the cap 40 is inserted at the predetermined position, the upper end 47 of the protruding portion 44 is positioned at the same level in height of the lowest mounting hole 33, preferably at the same or nearly same level as that of the lower edge of the smaller diameter portion 32 (32*d*).

Since the fuel supply pipe 30 is attached at the same time to four fuel injection valves 20 aligned in the vertical direction, the longitudinal direction thereof is oriented in the vertical direction. Therefore, when undesired water is entered into the fuel pipe, the water tends to gather in the lower portion in the vertical direction of the fuel supply pipe 30; i.e., in a place adjacent to the cap 40 closing the lower end of the fuel path 31. If such water remains for a long period of time, there is a possibility that the inside of the fuel supply pipe 30, the cap 40, the fuel injection valve 20 and the like will be corroded. However, the fuel supply pipe 30 according to the present invention is arranged so that the upper end 47 of the protruding portion 44 of the cap 40 is positioned at the same or nearly same level as that of the lower edge portion of the smaller diameter portion 32*d*. Therefore, even when undesired water is entered into the pipe, the water is smoothly sucked into the fuel injection valve 20 through the smaller diameter portion 32*d* along with the fuel without staying therein. The water sucked into the fuel injection valve 20 is combusted along with the fuel and exhausted as vapor out of the engine 2.

The outer diameter of the protruding portion 44 of the cap 40 according to the embodiment is arranged to be smaller than the outer diameter of the body 41, which is inserted into the cap insertion hole 31*a*, and to a dimension that the protruding portion 44 fits with the fuel path 31. As a result of this arrangement, it is possible to prevent perfectly the water from remaining between the periphery of the protruding portion 44 and the inner peripheral surface of the fuel path 31.

In the fuel supply pipe 30 according to the embodiment, since the fuel path 31 passes therethrough in its longitudinal direction, one fuel supply pipe 30 is attached with two caps 40. However, the fuel path 31 may be arranged to have a single opening at the lower end thereof and to attach the cap 40 to only the lower end thereof. The upper end 47 of the protruding portion 44 of the cap 40 may be positioned at a point slightly higher than that of the lower edge portion of the smaller diameter portion 32*d*.

In the above-described fuel supply pipe according to the embodiment, formed on the cap closing the fuel path formed inside the fuel supply pipe in the vertical direction from its lower side, is the protruding portion extending to the same position as that of the lower edge of the fuel injection valve mounting hole, which is continuous with the fuel path in the direction perpendicular thereto. Accordingly, undesired water entered inside the fuel path can be sucked into the fuel injection valve without delay thereby preventing the water from remaining inside the fuel supply pipe.

As a matter of course, the material and configuration of the fuel supply pipe and the cap, the configuration of the fuel path and the fuel injection valve mounting hole and the like are not limited to the above-described embodiment, but various modifications are possible. As a matter of course, the fuel supply pipe may be arranged, for example, as an assembly component, or the fuel supply device according to the present invention may be applied to a V-engine in which cylinders are aligned in two rows in the vertical direction.

What is claimed is:

1. A fuel supply device for supplying fuel to each of a plurality of fuel injection valves of a multi cylinder engine disposed with a plurality of cylinders in a vertical direction, the fuel supply device, comprising:

a fuel supply pipe formed with a fuel path extending upward from a lower end thereof, a cap inserted to close a lower end of said fuel supply pipe, and a plurality of mounting holes formed perpendicular to the fuel path, each of said plurality of mounting holes being adapted to fit a fuel inlet side of one of said plurality of fuel injection valves therein, wherein an upper end of said cap is disposed substantially at the same level in height as the lowest mounting hole among said plurality of mounting holes, and wherein said cap includes a collar to form a holding groove for an O-ring and a protruding portion having a smaller diameter than a body of said cap, said protruding portion extending toward the fuel oath from an upper side of said collar, wherein said upper end of said protruding portion forms said upper end of said cap.

2. The fuel supply device according to claim 1, wherein each of said plurality of mounting holes is constituted of a larger diameter portion adapted to fit a fuel inlet side of said fuel injection valve and a smaller diameter portion formed concentrically with said larger diameter portion, wherein said upper end of said cap is disposed substantially at the same height as a lower edge of said smaller diameter portion.

3. The fuel supply device according to claim 1, wherein a connector for a fuel hose supplying fuel to said fuel supply pipe is disposed at a substantially middle portion of said fuel supply pipe.

4. The fuel supply device according to claim 2, wherein a connector for a fuel hose supplying fuel to said fuel supply pipe is disposed at a substantially middle portion of said fuel supply pipe.

5. The fuel supply device according to claim 1, wherein a second cap is inserted to close an upper end of said fuel supply pipe.

6. The fuel supply device according to claim 2, wherein a second cap is inserted to close an upper end of said fuel supply pipe.

7. The fuel supply device according to claim 3, wherein a second cap is inserted to close an upper end of said fuel supply pipe.

8. The fuel supply device according to claim 4, wherein a second cap is inserted to close an upper end of said fuel supply pipe.

* * * * *